US005261671A

United States Patent [19]

Wyatt

[11] Patent Number: 5,261,671

[45] Date of Patent: Nov. 16, 1993

[54] BOARD GAME

[76] Inventor: Gary J. Wyatt, 116 Trentham Street, Southfields, London SW18 5DJ, England

[21] Appl. No.: 840,255

[22] Filed: Feb. 24, 1992

[30] Foreign Application Priority Data

Feb. 22, 1991 [GB] United Kingdom ..... 9103769
Jan. 13, 1992 [GB] United Kingdom ..... 9200570

[51] Int. Cl.[5] ..... A63F 3/00; A63F 9/18

[52] U.S. Cl. ..... 273/249; 273/272; 273/431

[58] Field of Search ..... 273/249-254, 273/243, 240, 256, 236, 272, 429-432

[56] References Cited

U.S. PATENT DOCUMENTS

| | | | |
|---|---|---|---|
| 1,635,734 | 7/1927 | Ziegler | 273/249 |
| 3,984,106 | 10/1976 | White | 273/243 |
| 4,484,748 | 11/1984 | Becze | 273/256 |
| 4,736,954 | 4/1988 | Haney et al. | 273/236 |
| 4,928,976 | 5/1990 | Vano et al. | 273/240 |
| 4,984,805 | 1/1991 | Medlock | 273/248 |
| 4,993,718 | 2/1991 | Dandridge | 273/249 |

FOREIGN PATENT DOCUMENTS

| | | | |
|---|---|---|---|
| 2189159 | 10/1987 | United Kingdom | 273/254 |
| 2198361 | 6/1988 | United Kingdom | 273/249 |
| 2223177 | 8/1988 | United Kingdom | 273/249 |
| 2233568 | 7/1989 | United Kingdom | 273/276 |

OTHER PUBLICATIONS

"Trivial Pursuit"—Pocket Edition—1988 Categories.

*Primary Examiner*—Benjamin H. Layno
*Attorney, Agent, or Firm*—Diller, Ramik & Wight

[57] ABSTRACT

A board game includes (a) on a playing board a series of lettered boxes arranged as a playing course between START and FINISH boxes, and (b) a key which relates the indicia (e.g. numerals, colours, or pictures) appearing on the respective faces of a die to respective categories of things, objects, people, features, etc. The rules of the game require that a player's token standing on a given box can move to the next box only when the player has thrown the die, consulted the key to determine therefrom the category related to the number, colour, picture, or other indicium on the die face which is upwardly exposed by the throw of the die, and named a specific variety within that category, which variety has a name beginning with the letter of the box on which the player's token is currently standing.

16 Claims, 3 Drawing Sheets

BOARD GAME

Figure 1:
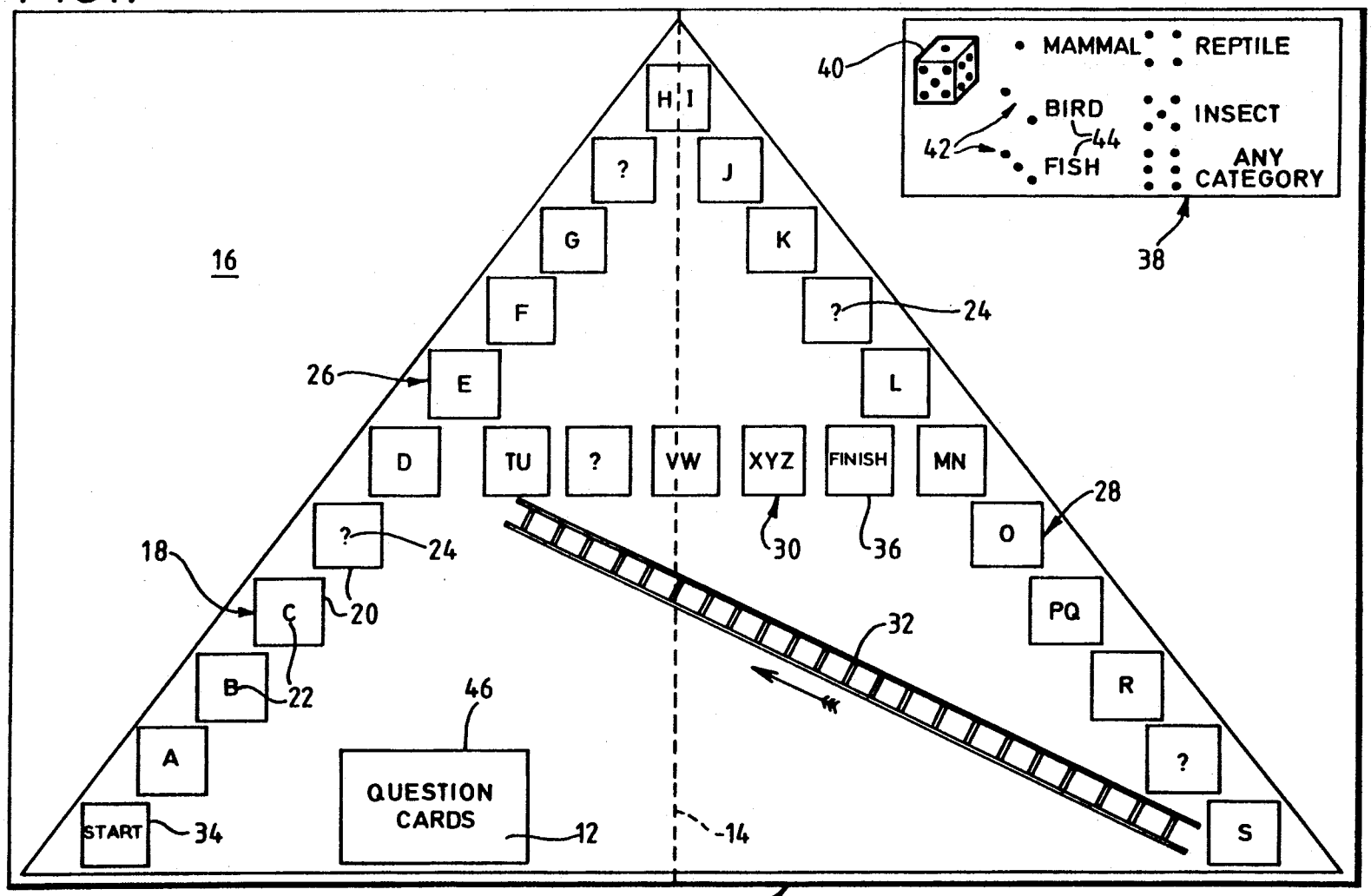

This invention relates to a board game.

Various prior art board games have typically comprised:

(a) a playing board having a playing surface;

(b) a playing course depicted on said playing surface and comprising a plurality of playing positions or 'boxes' arranged in a sequence of predetermined configuration, said sequence including at one end thereof a starting box and at the opposite end thereof a finishing box;

(c) a plurality of player's tokens arranged for movement along said playing course from one box to another by respective players;

(d) at least one die having a plurality of faces bearing respectively different indicia, for use by a player in randomly selecting one of said indicia; and (e) a set of rules stipulating the manner in which the players shall use the die and pursuant thereto progress their respective tokens from said starting box to said finishing box.

Moreover, in such prior art games the respective faces of the die have carried representations of the numerals '1' to '6', in the form of appropriate numbers of dots arranged in appropriate patterns.

In such prior art games, the mere throw of the die (or dice) and the numeral revealed thereby have determined the rate of progress of a player's token along the sequence of boxes, so that such progress has been dependent solely on the luck of the player in throwing the die (or dice) to achieve high numbers.

According to the present invention, a game having the features referred to at (a) to (e) above is characterised by the following features (f) a plurality of alphabetic letters displayed at the respective boxes so that each box has associated therewith at least one predetermined letter;

(g) a key portraying representations of the respective indicia appearing on said die faces and in association with them respective representations specifying respective predetermined categories selected from the group comprising at least persons, animals, other animate objects, plants, other vegitation, inanimate objects, places, features, materials and activities;

(h) rules stipulating (1) that for a player in his turn to move his player's token from one said box to a predetermined next one in the sequence that player must first throw the die to randomly reveal on the upwardly exposed die face one of said indicia, then determine from said key the category corresponding to that one of said indicia, and finally name a specific variety within that category, which variety has a name commencing with the aliphabetic letter associated with the box on which the player's token is currently standing, (2) that on naming such a specific variety the player's token may be moved to said predetermined next box, and the die be thrown again by the same player to advance the game in like manner, and (3) that on failure of the player to correctly name such a specific variety a next one of the players may throw the die instead to continue the game in like manner.

Thus, in games according to the present invention, not only is the throw of the die important in determining the progress (though not the rate of progress) of a player's token, but also the knowledge of the player and his ability to name a specific variety of a category which is determined by the throw of the die, and which variety accords with the letter of the box on which the player's token is standing.

A player may play as an individual playing against other individuals, or as a member of a group of players acting as a team which is competing against other teams of players.

A board game according to the present invention may also include any one or more of the following optional features:

(a) said key is portrayed on the playing surface of the playing board;

(b) said key comprises a plurality of printed segments aligned along an edge portion of the playing surface, each said printed segment comprising one of said indicia of the die, and adjacent thereto the associated category representation;

(c) one or more replicas of said key are disposed along one or more other edge portions of the playing surface;

(d) said sequence of boxes is arranged in the configuration of an alphabet letter;

(e) when the configuration of a said alphabet letter is discontinuous, said sequence of boxes includes at least one link connecting a free end of the alphabet letter with a non-contiguous box thereby to provide a continuous path between the starting and finishing boxes;

(f) said configuration is that of spiral, and one of said starting and finishing boxes is disposed at an inner end of the spiral and the other one of said starting and finishing boxes is disposed at an outer end of the spiral;

(g) said boxes are printed on the playing surface;

(h) each said box includes an aperture formed in the playing board, and each said player's token includes a projecting peg for insertion in such an aperture thereby to retain the player's token stably in position on the associated box;

(i) said rules stipulate that said predetermined next box comprises the box which lies immediately adjacent the box on which the player's token is currently standing;

(j) said rules stipulate that said predetermined next box comprises a box which is spaced a predetermined number of boxes away from the box on which the player's token is currently standing, except when that next box would lie beyond the finishing box;

(k) the respective faces of the die carry representations of the numerals '1' to '6', such representations being in the form of appropriate numbers of dots arranged in appropriate patterns;

(l) at least one box has associated therewith two or more said alphabetic letters;

(m) said categories have a common genus; and (n) said categories all comprise kinds of animal.

Other features will appear from a reading of the description that follows hereafter and of the claims appended at the end of that description.

Figure 2A:
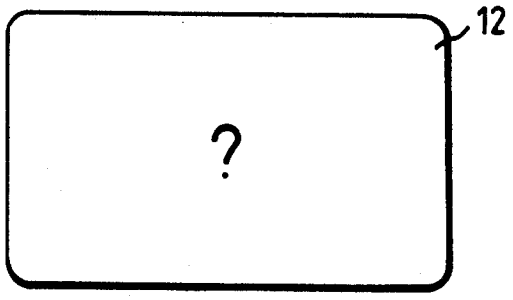
Figure 2B:
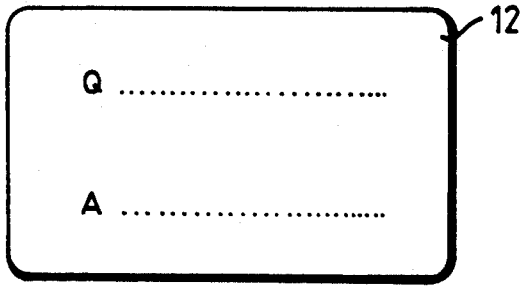
Figure 3:
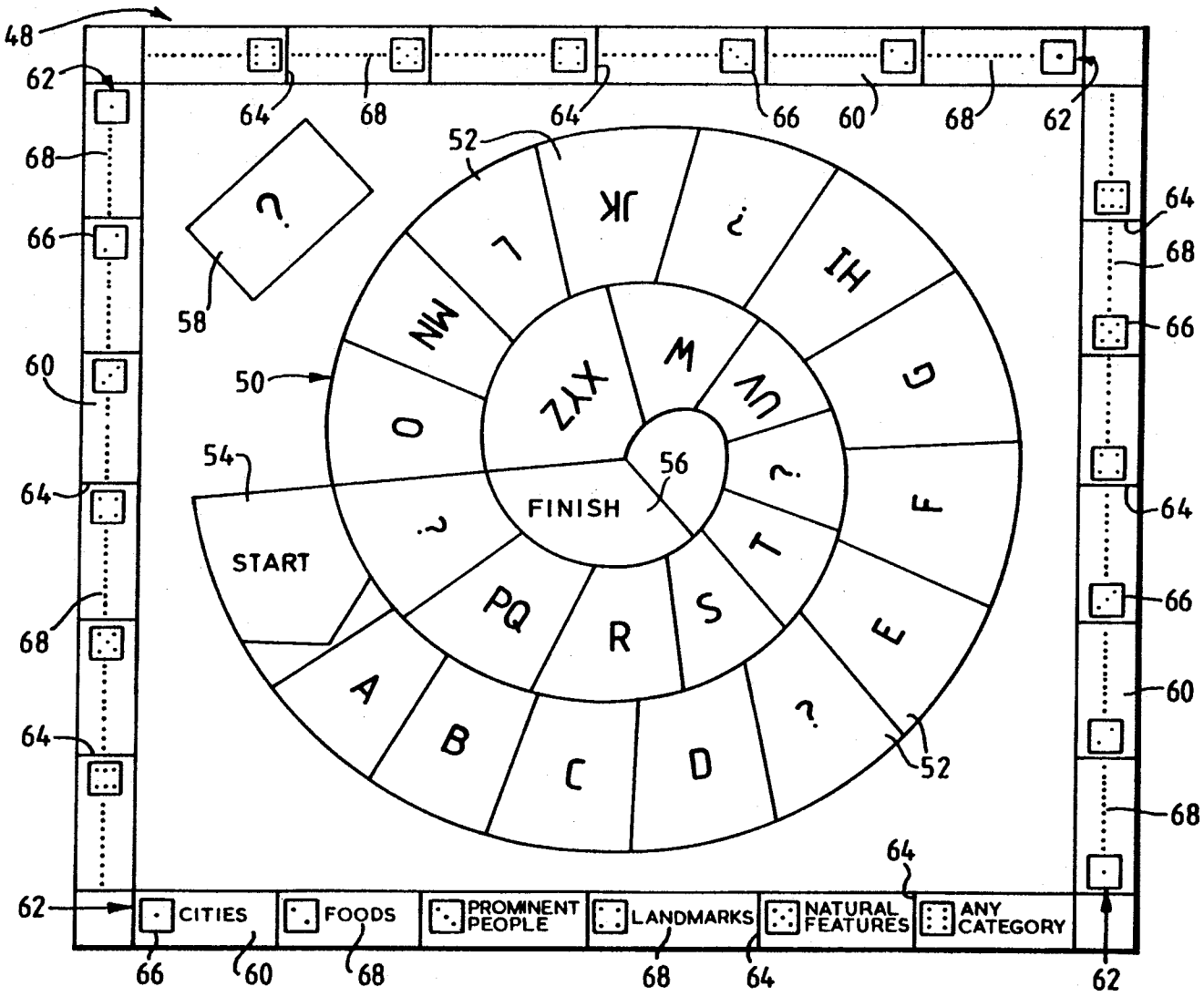

Two board games and various modifications thereof, all according to the present invention, will now be described by way of example and with reference to the accompanying diagrammatic drawings, in which:

FIG. 1 shows the upper playing surface of a first playing board for use in a first one of the two board games:

FIGS. 2(*a*) and 2(*b*) show the front and rear faces of one of a plurality of 'Question Cards' which are intended for use in connection with the playing board of FIG. 1;

FIG. 3 shows the playing surface of a second playing board for use in the second of the two board games.

Referring now to the FIGS. 1 and 2, the first game is an 'animal game', and comprises a playing board 10, a series of player's tokens (not shown) which are in the form of various different animals (or which otherwise carry representations of such animals), a conventional six-sided die (not shown), and a rule book (not shown) containing the rules for playing the game. The game also includes, if desired, a pack of QUESTION CARDS 12.

The playing board 10 comprises a stiff rectangular board which is foldable along a crease indicated by the dotted line 14 for convenience in carrying and transporting the game. The board has on its upper face a playing surface 16 carrying a printed representation of a playing course 18 which comprises a number of square boxes 20 arranged in the configuration of the letter 'A'. The majority of the respective boxes 20 carry representations 22 of the various alphabet letters 'A' to 'Z', whilst the remaining boxes carry representations 24 of a question mark '?'. In most cases, the boxes have only a single letter each, but some boxes carry more that one letter, e.g. 'H I', and 'X Y Z'. The 'A' shaped playing course includes left and right inclined limbs 26, 28, a transverse cross bar 30 joining them, and a connecting ladder or link 32 interconnecting the lower right hand box bearing the letter 'S' and the box bearing the letters 'T U' situated at the left hand end of the cross bar 30.

The playing course 18 commences at a START box 34 disposed below the lower left box bearing the letter 'A', proceeds up the left limb 26 to the apex box bearing the letters 'H I', then down the right limb 28 to the lower right box bearing the letter 'S'. From there, the course proceeds by way of the connecting ladder 32 to the box carrying the letters 'T U', then to the right along the cross bar 30, and finishes at a FINISH box 36 which is situated at the right hand side of the cross bar 30, to the right of the box carrying the letters 'X Y Z'.

The connecting ladder 32 overcomes the discontinuity in the 'A' shape of the playing course, and provides a continuous course using all parts of the 'A' configuration.

The playing surface 16 also bears at its upper right hand corner (as seen in the FIG. 1) a ruled-off area which contains a KEY 38. That key comprises an image 40 of a die, alongside it respective representations 42 of the six configurations of dots which appear on the respective faces of the die 40, and alongside those dot configurations respective inscriptions 44 specifying particular categories of animals, i.e. 1=mammal, 2=bird, 3=fish, 4=reptile or amphibian, 5=spider or insect, 6=any of those categories.

The playing surface 16 has also an enclosed area 46, which bears the inscription 'QUESTION CARDS', and which is intended to carry during play a pack or deck of QUESTION CARDS. Each such card bears on one side thereof, the exposed side, a question mark '?' as shown in the FIG. 2(*a*), and on the other side, the hidden side, one or more questions and the answers associated therewith, as shown in FIG. 2(*b*). Where a card bears two or more questions, the questions are graded according to the degree of difficulty in answering them. During play, the QUESTION CARDS are placed on the area 46 with their question-and-answer sides facing downwards.

Examples of such questions (Q.) and answers (A.) are as follows:

Q. Which of the following mammals is not an insectivore: HEDGEHOGS, MOLES, SHREWS, RABBITS?
A. RABBITS.

Q. Which of the following is not a mammal: BAT, DOLPHIN, SEAL, CROCODILE?
A. CROCODILE.

Q. Which of the following are warm blooded: CATFISH, FROGS, SHARKS, WHALES?
A. WHALES (all mammals are warm blooded).

The object of the game is for each player to progress his token along the playing course from the START box to the FINISH box as speedily as possible, moving his token in accordance with the rules of the game (and thus indirectly in dependence upon the throw of the die). The winner of the game is the player who first arrives at the FINISH box, and thereupon correctly answers the question posed on the then uppermost QUESTION CARD.

The game is played in the following manner:

Each player in his turn moves his token from the START box to the adjacent box, which bears the letter 'A'. Thereupon the player throws or rolls the die, and consults the key to ascertain the category of animal that is associated with the pattern or number of dots appearing on the upwardly exposed face of the die. Thereupon, the player is required to name a variety of animal of that particular category, which variety has a name beginning with the letter 'A' (being the letter of the box on which the player's token is currently standing).

If the player succeeds in doing that, the player's token is moved on to the next adjacent box, which bears the letter 'B', and again repeats the process, namely, the player throws the die, consults the key, determines therefrom the animal category corresponding to the number revealed by the throw of the die, and finally names a variety of animal within that category having a name beginning with the letter 'B' (the letter of the box upon which the player's token is then currently standing).

If the player is again successful, the player's token is again moved to the next box, which bears the letter 'C', and the process is repeated, this time to name a variety of animal within the category determined by the throw of the die and the key, which variety has a name beginning with the letter 'C'.

If the player is again successful, the player's token is again advanced to the next box, which bears a question mark '?'. In this case, the next person on the left of the current player picks up the uppermost QUESTION CARD and reads therefrom the multiple-choice question shown on the reverse side of that card. If the player gives the correct answer as shown on the card, the player's token is again moved on to the next box, which bears the letter 'D', and repeats the process to name a variety of animal within the category determined by the throw of the die and the key, which variety has a name beginning with the letter 'D'.

If on the other hand, the player fails, on moving his token to a next box, to correctly name a variety of animal within the category determined by the throw of the die and the designation of the key, or to correctly answer a question posed by a QUESTION CARD, the player's token remains on that box, and the token of the next player on the left is moved from the START box on to the box marked 'A', in readiness for that new player to carry on the process described above in relation to the play of the first player.

In the course of playing the game, no player is allowed to name an animal variety that has already been correctly named earlier in the game by another player in the course of his play. For example, if a player has already named an 'eagle' as a variety of bird after throwing a 'two' on the die when the player's token stood on the 'E' box, no subsequent player can name an 'eagle' in similar circumstances.

Since on termination of a player's turn (i.e. on failure to correctly name an animal variety of the designated category, or to correctly answer a question from a QUESTION CARD) the player's token remains on the same box, at his next turn to play the player must, after throwing the die, name an animal variety of the designated category having an initial letter as determined by the box on which the player's token has remained standing, before the player may advance his token.

When a player's token moves on to a box bearing more than one letter (e.g. 'T U'), the player is at liberty to mention an animal variety having as its initial letter either or any one of the letters shown on the box.

The pack of QUESTION CARDS may include other cards, which on being picked up by a player dictate advantageous or disadvantageous additional movements of the player's token. Such other cards may comprise BONUS CARDS, which assist the player's progress along the playing course (e.g. by telling the player to advance his token a stated number of boxes along the course), or DISASTER CARDS which delay or even temporarily reverse the player's progress along the course (e.g. by telling the player to miss a stated number of turns to play, or to go back a stated number of boxes). Some BONUS CARDS state that they should be retained and used later to nullify a subsequently picked up DISASTER CARD.

Where a QUESTION CARD carries more than one question-and-answer, the questions may be designated on the card as 'harder' and 'easier', in which case the current player is given the choice—to answer the harder or the easier question. If the player opts to answer the easier question, and correctly answers that question, the player's token is moved on in the normal way to the next adjacent box, but if the player fails to give the correct answer his turn ceases and the token remains on the same box. On the other hand, if the player has opted to answer the harder question and has correctly answered it, the player's token is moved on to the next but one box, whereas if the player fails to give the correct answer, his token is moved back a stated number of boxes (e.g. one box).

By way of example, if when a player's token is standing on the box 'A', the player throws the die to reveal a single dot uppermost (i.e. he has thrown a 'ONE'), the player finds from the key that a throw of 'ONE' represents the category 'MAMMAL'. Hence, the player is required to name a variety of mammal having an initial letter 'A'. In response, the player may correctly name as a mammal the variety 'antelope', in which case the player may then move his token on to the box 'B' and again throw the die. If the throw of the die reveals a 'THREE', the category of animal in which the player must then name a variety is 'FISH', and the player must then name a variety of fish having an initial letter 'B', for example 'BARRACUDA'. And so on!.

To aid the players in settling differences of opinion concerning the categories in which different varieties of animal fall, a comprehensive reference list of animals and their respective animal categories is provided.

Should the current player be challenged by another player over the correctness of his choice of named animal variety, the current player is awarded a bonus in the event that the challenge proves false, whereas should the challenge be correct, the token of the current player is moved back a set number of boxes (e.g. two boxes).

The game may be started by selecting in any convenient manner the player to play first, for example, by selecting the player achieving the highest score in a preliminary round of throwing the die.

The playing board, tokens, QUESTION CARD pack, animal reference list, and die are supplemented by a RULE BOOK which sets out inter alia the rules of the game, which will be apparent from the above-described playing procedure.

The above described playing board may be modified by arranging the sequence of boxes in the configuration of any other convenient letter of the alphabet, for example, in the form of a capital letter 'O', 'S', 'W', etc.

Alternatively, the sequence of boxes may be arranged in the form of a spiral, having the START and FINISH boxes at opposite ends of the spiral. Furthermore, other convenient configurations of the playing course may be used if desired.

Whereas in FIG. 1, the alphabet letters have been arranged in the normal alphabetic sequence on the respective boxes, they could be arranged in any other desired sequence, random or otherwise.

Whereas in FIG. 1, the QUESTION boxes have been arranged non-uniformly in the box/letter sequence, they could alternatively be disposed at uniform intervals in that sequence.

In the game described above, each player's token has been advanced to the next adjacent box each time the player has correctly named an animal variety. If desired, the game may be speeded up by advancing the token two boxes instead of one, except where such an advance would take the token beyond the FINISH box.

Whereas the playing surface 16 is shown as carrying the key 38, if desired as an addition or as an alternative, the key may be provided on separate cards, for example one for each of the players.

Whereas the boxes 20 are represented by rectangles printed on the playing surface 16, other forms of box may be used instead. For example, the boxes may include or comprise holes formed in the playing board into which pegs formed on the players' tokens may by inserted so as to secure the tokens in position.

Whilst the games described with reference to the FIGS. 1 and 2 are concerned with categories and varieties of ANIMAL, other games within the scope of the present invention (and using the same or similar components of the game) relate to categories and varieties of other sorts of subject matter.

For example:

(a) the game may relate to various aspects of the NATURAL WORLD, and use categories as follows: 1. COUNTRY: 2. RIVER/MOUNTAIN/DESERT: 3. TREE: 4. FLOWER: 5. FRUIT/VEGATABLE: 6. ANY OF THE EARLIER CATEGORIES.

(b) the game may relate to HUMAN ACTIVITIES and persons involved therein, and use categories as follows: 1. PAINTERS: 2. ACTORS: 3. AUTHORS: 4. POLITICIANS: 5. POETS: 6. SPORTS-PEOPLE.

(c) the game may relate to HUMAN ACTIVITIES and materials used therein, and use categories as follows: 1. COOKING: 2. CLOTHING: 3. AGRICULTURE: 4. MANUFACTURE: 5. ENTERTAINMENT: 6. HOBBIES.

(d) the game may relate to CONTINENTS and geographical features (e.g. towns, rivers, mountains) thereof, and use categories as follows: 1. EUROPE: 2. ASIA: 3. INDIA: 4. NORTH & SOUTH AMERICA: 5. AFRICA: 6. THE ARCTIC/ANTARTIC.

(e) the game may relate to ENTERTAINMENT and persons or features involved therein, and use categories as follows: 1. TELEVISION: 2. RADIO: 3. FILMS: 4. THEATRE: 5. PHOTOGRAPHY: 6. SPORTING EVENTS.

Whereas in the above examples, the categories all fall within the umbrella of a common genus, in other games according to the present invention, the different categories may be selected from different fields and so have no common aspect.

Thus, the categories for a particular game may be selected at random, for example from the above list of possible games, as follows: 1. EUROPE: 2. SPORTING EVENTS: 3. COOKING: 4. MAMMAL: 5. HOBBIES: 6. ACTORS.

The second game referred to above relates to a group of categories which have no common genus, and employs a playing board having a playing surface as shown in FIG. 3 at reference 48. That playing surface has a playing course 50 which comprises a sequence of boxes 52 arranged in the form of a spiral, and which has outermost a START box 54 and innermost a FINISH box 56. A rectangular area 58 is marked out for receiving a pack of QUESTION CARDS.

Along each of the four edge portions 60 of the playing surface 48 is disposed a key generally indicated at 62, and comprising a plurality of linear segments 64 arranged in line with one another. Each such segment 64 includes a representation 66 of one face of the die, and alongside it an associated inscription 68 designating one of a selected group of categories. The repetition of the key alongside each edge portion of the playing surface ensures that each one of a group of players sitting around the playing board can easily read the contents of the key.

The categories in this second game comprise the following: 1. CITIES: 2. FOODS: 3. PROMINENT PEOPLE: 4. LANDMARKS: 5. NATURAL FEATURES: 6. ANY OF THE EARLIER CATEGORIES.

This second game is played in a manner similar to that of the animal game described with reference to the FIGS. 1 and 2.

Whereas in the games described above, the faces of the die have carried—as indicia—representations of the numerals '1' to '6' in the form of appropriate patterns of appropriate numbers of dots, in other versions of those games, the die may have instead on its respective faces indicia in the form of (a) respective different colours, or (b) respective pictures of different objects (animate or inanimate). In that case, the key includes, instead of the respective patterns of dots, respective areas of the respective colours that appear on the respective faces of the die, or as appropriate the respective pictures that appear on the respective faces of the die.

Whereas in the games described above, the 'A' box is preceded by the START box, and the 'XYZ' box is followed by a FINISH box, those START and FINISH boxes may be omitted in other versions of the games, in which case the respective player's tokens are placed in turn directly on to the 'A' box (which is thus a 'starting box') at the commencement of each player's play, and are removed from the 'XYZ' box (which is thus a 'finishing box') once the associated QUESTION CARDS have been successfully answered by the respective players.

Whereas in the games described above, the boxes are printed on the playing surface, in other versions of those games the printed boxes may be omitted, and be replaced by holes or other devices formed in or on the playing board and arranged to be occupied by pegs or other cooperating devices formed on the respective player's tokens.

A slightly modified version of the game described above with reference to FIG. 3, and called "ALPHA ANIMALS", has the set of RULES set out below. In that modified game, the BONUS CARDS and the DISASTER CARDS have been combined into a set of WILD CARDS, the QUESTION CARDS and the WILD CARDS are referred to by the single name ALPHA CARDS, the respective categories are referred to as ALPHA ANIMAL CATEGORIES, and the QUESTION BOXES are referred to as ALPHA BOXES.

RULES

The object of the game is to move from the start box to the finish box by moving your token along the letters of the alphabet from A to Z. The winner is the first player to reach the finish box and correctly answer a QUESTION CARD.

To decide the order of play all players roll the die and the player with the highest number goes first and chooses a token to play with. The person on his/her left goes second, and so on.

MOVING THROUGH THE ALPHABET

The first player places his token on the letter 'A' and rolls the die. The number thrown corresponds to one of the ALPHA ANIMAL CATEGORIES shown around the edge of the board. Before the player can move from 'A' he/she must name an animal from the appropriate category.

One dot on the die=MAMMAL
Two dots on the die=FISH
Three dots on the die=BIRD
Four dots on the die=REPTILE or AMPHIBIAN
Five dots on the die=INSECT, SPIDER or CRUSTACEAN
Six dots on the die=ANY CATEGORY For example, if the first person rolls a '1', that player must name a mammal beginning with 'A'. If a correct answer is given, e.g. Antelope, that first person continues by moving his/her token to 'B' and rolling the die again. If a '2' is thrown, a fish beginning with 'B' must be nominated. If a correct answer is given, e.g. Barracuda, the player continues by moving his/her token on to 'C' and rolling the die again. When the first player cannot answer or gives a wrong answer, it is the second player's turn. That player then places his/her token on 'A' and rolls the die and proceeds as above.

GREEN ALPHA BOXES

A feature of the game is the GREEN ALPHA BOXES. The first follows the letter 'D'. When a player answers 'D' correctly, the player has to move on to the GREEN ALPHA BOX. When this happens, the person to the left of the current player picks up the top card from the deck of ALPHA CARDS. There are two types of ALPHA CARD:

1. QUESTION CARD
2. WILD CARD.

If a QUESTION CARD is picked up, the player on the ALPHA box must decide if he/she wants an easier or a harder question. BEWARE! As in nature, there are perils in any journey. If the easier question is answered correctly the player moves to the next alphabet box. If the wrong answer is given, the player has to remain on the ALPHA BOX and must continue with an ALPHA CARD on the player's next turn.

If the harder question is answered correctly, the player moves forward two alphabet boxes. If the wrong answer is given, the player must move back one alphabet box.

If a WILD CARD is picked up, it must be handed to the player as it will move the player forward or back. Picking up a WILD CARD marks the end of that player's turn.

NO REPEATS

No animal can be named on an alphabet box if it has been named by somebody else before. For example, if a player has already been on 'E' and named an Eagle as a bird, a player who arrives on 'E' later in the game cannot name 'Eagle' as well. This also applies to players who have incurred a penalty.

It may be helpful the first time you play to have a pen and paper ready and write down all nominated animals so that they are not named again.

DISPUTES

To help in cases of disputes as to whether a named animal is correct, a listing of common animals appears in a separate leaflet. If a player challenges another player's answer and that answer is correct, the challenger has to move back two alphabet boxes. If the challenger is correct and the answer given is wrong, the player who gave the wrong answer has to move back two alphabet boxes.

Some boxes have more than one letter of the alphabet on them. Any of the letters on that box can be used.

Instead of using in the above described games a die to randomly select a number within the range '1' to '6', any other equivalent player-operable means may be used; for example, a conventional spinner comprising a hexagon-shaped card mounted on a central spindle and arranged for spinning on a table surface by a player, the respective sides of the card bearing numbers in that range, and the randomly selected number being the number associated with the side of the card that falls to rest in contact with the table surface. For numbers in a greater range, the hexagonal spinner card may be replaced by polygonal card having an appropriately greater number of sides.

I am aware of the following items of relevant prior art:

(a) patent specification GB 2,223,177 A (BAMBRIDGE);

(b) patent specification GB 2,233,568 A (JONES);

(c) patent specification U.S. Pat. No. 3,984,106 (WHITE);

(d) a game known as 'TRIVIAL PURSUIT'; and (e) a game known as 'CATEGROES'.

I claim:

1. A board game comprising:

(a) a playing board having a playing surface;

(b) a playing course on said playing surface including a plurality of playing position boxes arranged in a sequence of predetermined configuration, said sequence including at one end thereof a starting position box and at the opposite end thereof a finishing position box;

(c) a plurality of player's tokens each arranged for movement by a player along said playing course from one position box to a predetermined next position box in a predetermined sequence;

(d) a plurality of alphabetic letters depicted at the respective position boxes thereby to associate with each position box at least one predetermined letter, which constitutes the initial letter of a word to be named by a player whose token stands on the position box;

(e) at least one random selection means having a plurality of portions bearing respectively different indicia, for operation by a player to randomly select one of said indicia; and (f) a key portraying representations of the respective indicia appearing on said portions and in association with them respective representations specifying respective predetermined categories, thereby on operation of said random selection means by a player to select one said indicia, said player randomly selects one said category; said initial letter and said selected category together specifying limits within which a player whose token stands on a position box may name a word representing a variety within the selected category; said token being moveable to said next predetermined position box only on the naming correctly of a word within said limits by said player; and said predetermined categories being chosen from a list which includes at least the following categories of knowledge: persons, animals, other animate objects, plants, other vegetation, inanimate objects, places, features, materials and activities.

2. A board game according to claim 1, wherein said key is portrayed on the playing surface of the playing board, and includes a row of printed segments aligned along an edge portion of the playing surface, each said printed segment comprising one of said indicia of the random selection means, and adjacent thereto the associated category representation.

3. A board game according to claim 2, wherein a replica of said key is disposed along at least one other edge portion of the playing surface.

4. A board game according to claim 3, wherein replicas of said key are disposed along other edge portions of the playing surface.

5. A board game according to claim 1, wherein said sequence of position boxes is arranged in the configuration of an alphabet letter.

6. A board game according to claim 5, wherein said configuration of said alphabet letter is discontinuous, and said sequence of position boxes includes at least one link connecting a free end of the alphabet letter with a non-contiguous position box thereby to provide a continuous path between the starting and finishing boxes.

7. A board game according to claim 1, wherein said configuration is that of a spiral, and one of said starting and finishing boxes is disposed at an inner end of the spiral and the other one of said starting and finishing boxes is disposed at an outer end of the spiral.

8. A board game according to claim 1, wherein said position boxes are printed on the playing surface.

9. A board game according to claim 1, wherein each said position box includes an aperture formed in the playing board, and each said player's token includes a projecting peg for insertion in such an aperture thereby to retain the player's token in a stable position on the associated position box.

10. A board game according to claim 1, wherein said predetermined next position box comprises the position box which lies immediately adjacent the position box on which the player's token is currently standing.

11. A board game according to claim 1, wherein said predetermined next position box comprises a position box which is spaced a predetermined number of position boxes away from the position box on which the player's token is currently standing, except when that next position box would lie beyond the finishing box.

12. A board game according to claim 1, wherein the random selection means comprises a die carrying on its respective faces respective representations of the numerals '1' to '6', such representations being in the form of appropriate numbers of dots arranged in appropriate patterns.

13. A board game according to claim 1, wherein at least one position box has associated therewith two or more said alphabetic letters.

14. A board game according to claim 1, wherein said categories have a common genus.

15. A board game according to claim 14, wherein said categories all comprise kinds of animals.

16. A board game according to claim 1, wherein said letters are arranged in alphabetic sequence between said starting and finishing boxes.

* * * * *